United States Patent [19]

Paukert

[11] Patent Number: 4,793,735

[45] Date of Patent: Dec. 27, 1988

[54] VIBRATORY ROLLER STEERING SYSTEM

[75] Inventor: Julius Paukert, Munich, Fed. Rep. of Germany

[73] Assignee: Wacker Werke GmbH & Co. KG, Munich, Fed. Rep. of Germany

[21] Appl. No.: 117,931

[22] Filed: Nov. 3, 1987

Related U.S. Application Data

[63] Continuation of Ser. No. 798,130, Nov. 14, 1985, abandoned.

[30] Foreign Application Priority Data

Nov. 14, 1984 [DE] Fed. Rep. of Germany ..... 3441625

[51] Int. Cl.[4] ..... E02D 3/032

[52] U.S. Cl. ..... 404/126; 404/131; 404/117; 180/20

[58] Field of Search ..... 404/122, 125–128, 404/132, 117; 180/6.48, 20, 6.5; 267/150

[56] References Cited

U.S. PATENT DOCUMENTS

| | | | |
|---|---|---|---|
| 3,250,524 | 5/1966 | Boatright | 267/150 X |
| 3,394,641 | 7/1968 | Steck | 404/122 |
| 3,666,034 | 5/1972 | Stuller et al. | 180/6.48 |
| 3,763,944 | 10/1973 | Kaltenegger | 180/20 X |
| 3,866,700 | 2/1975 | Bauer | 180/6.48 |
| 3,868,194 | 2/1975 | Ferguson et al. | 404/126 |
| 4,109,742 | 8/1978 | Fairchild et al. | 404/126 X |
| 4,172,501 | 10/1979 | Murray | 180/20 X |
| 4,449,598 | 5/1984 | Hönes et al. | 180/6.5 |
| 4,471,850 | 9/1984 | Rotz | 404/126 X |
| 4,505,349 | 3/1985 | Murphy | 404/126 X |
| 4,679,962 | 7/1987 | Mihara et al. | 404/126 |

*Primary Examiner*—Stephen J. Novosad
*Assistant Examiner*—Matthew Smith
*Attorney, Agent, or Firm*—Becker & Becker

[57] ABSTRACT

A vibratory roller having four drums that can be vibrated. The drums are driven individually, and are mounted in pairs in respective supports. One of the supports is attached to a front frame, and the other support is attached to a rear frame. The object of the invention is to improve the steering condition of vibratory rollers, and especially of trench rollers, in such a way that on the one hand changes in direction during normal travel, or small corrections in direction, can be rapidly undertaken without damaging the already compacted surface of the ground, and that on the other hand it is also possible to make sharp changes in direction practically on the spot. Previously known types of steering for vibratory rollers, namely fifth-wheel steering, transfer steering, articulated steering, and panzer steering, do not permit such a diversified steering condition. Pursuant to the invention, the desired steering condition is achieved by interconnecting the front and rear frames via a hinged or swivel coupling. The frames are pivotable relative to one another via a steering cylinder. When the steering cylinder is not actuated, the frames are positively held in the angular position corresponding to straight ahead travel. The drums disposed on one side of the roller can be driven and controlled in common and independently from the drums disposed on the other side of the roller.

3 Claims, 1 Drawing Sheet

VIBRATORY ROLLER STEERING SYSTEM

This application is a continuation of copending application Ser. No. 798,130-Paukert filed Nov. 14, 1985 belonging to the assignee of the present invention and now abandoned.

BACKGROUND OF THE INVENTION

1. Field of the Invention

The present invention relates to a vibratory roller, especially a trench roller, having four drums that can be vibrated. The drums are driven individually, and are rotatably mounted, in pairs, on a front or rear support means, with the front support means being attached to a front frame, and the rear support means being attached to a rear frame.

2. Description of the Prior Art

Various basic types of steering systems are known for guiding or steering vibratory rollers, namely pivoted bogie steering or fifth-wheel steering, transfer steering, articulated steering, and the so-called panzer steering. With the articulated steering system, the vibratory roller has a front frame and a rear frame that are interconnected via a hinged or swivel coupling. Each frame supports a pair of drums. The front and rear frames are pivotable relative to one another, via a steering cylinder or the like, through a specific angular range, which for the drum includes a straight ahead position and toward both sides thereof an angular range for driving in curves toward one side or the other of the roller. With the panzer steering system, the four similarly paired drums are disposed on a common, rigid roller frame. Of the four individually driven drums, in each case the two left or the two right drums can be oppositely controlled, so that thereupon the drums on the one side of the roller can run in the direction opposite to those drums on the other side of the roller, or only those drums on one side of the roller need to be driven, as a result of which, as with the steering system of a tank, it is possible to rotate the roller on the spot.

All of the aforementioned types of steering systems have drawbacks for a trench roller.

The fifth-wheel, transfer, and articulated steering systems require for each change in direction a relatively large turning radius that is determined by the design involved, and that is disadvantageous in narrow trenches, particularly at the site of branches.

Although with the panzer or tank steering system a rotation on the spot about the center point of the roller is possible, thus meeting the necessary maneuverability for a trench roller, this steering system has two further significant drawbacks. One drawback is that for every change in direction, or even slight correction in the direction, the continuous travel must be interrupted in order to stop the drums on one side or, as is necessary in most cases, to operate the left and right drums in opposite directions. The unavoidable consequence of this is that the already compacted surface of the ground is torn up. The other drawback is that the speed with which the direction can be changed (angular speed about a vertical axis), in addition to being a function of the driving speed, also depends on the one hand upon the coefficient of friction between the drums and the ground, and on the other hand depends upon the ratio of the wheel base of the drums to their width. The less the friction, the poorer is the steering effect. When the ground is soft and the drums have partially sunk in, it is no longer possible to steer the roller. The less the width of the drums at a given wheel base, the poorer is the steering effect.

An object of the present invention is to improve the steering condition of vibratory rollers, and especially of trench rollers, in such a way that changes in direction during normal travel, or slight corrections in the direction, can be undertaken rapidly and without damaging the already compacted surface of the ground. In addition, it should be possible to undertake sharp changes in direction practically on the spot when it is necessary to deviate from normal travel, for example at a branch in the trench.

BRIEF DESCRIPTION OF THE DRAWINGS

These objects, and other objects and advantages of the present invention, will appear more clearly from the following specification in conjunction with the accompanying drawings, in which.

SUMMARY OF THE INVENTION

The vibratory roller of present invention is characterized primarily by a hinged or swivel coupling that interconnects the front and rear frames; a guide or steering cylinder or the like for pivoting the frames relative to one another about the coupling; a tension accumulator for holding the frames, when the steering cylinder is not actuated, in a relative angular position in which the pairs of drums assume a straight-ahead travel position; and drive means for the drums; those drums of the two pairs of drums on a given side of the roller are controllable in common and independently of those drums disposed on the other side of the roller.

With the inventive vibratory roller, the normal travel with limited changes in direction or slight corrections of the direction is carried out pursuant to the principle of articulated steering, that enables immediate changes in direction without interrupting travel and without damaging the already compacted ground. On the other hand, the inventive vibratory roller permits a rotation on the spot pursuant to the principle of panzer steering with the aid of the tension accumulator means, which for this purpose, when the steering cylinder or the like is not actuated, effectively makes the two pivotably interconnected frame parts an essentially rigid unit that is essentially aligned for straight-ahead travel.

Further advantageous embodiments of the present invention will be described subsequently.

DESCRIPTION OF PREFERRED EMBODIMENTS

Figure 1:
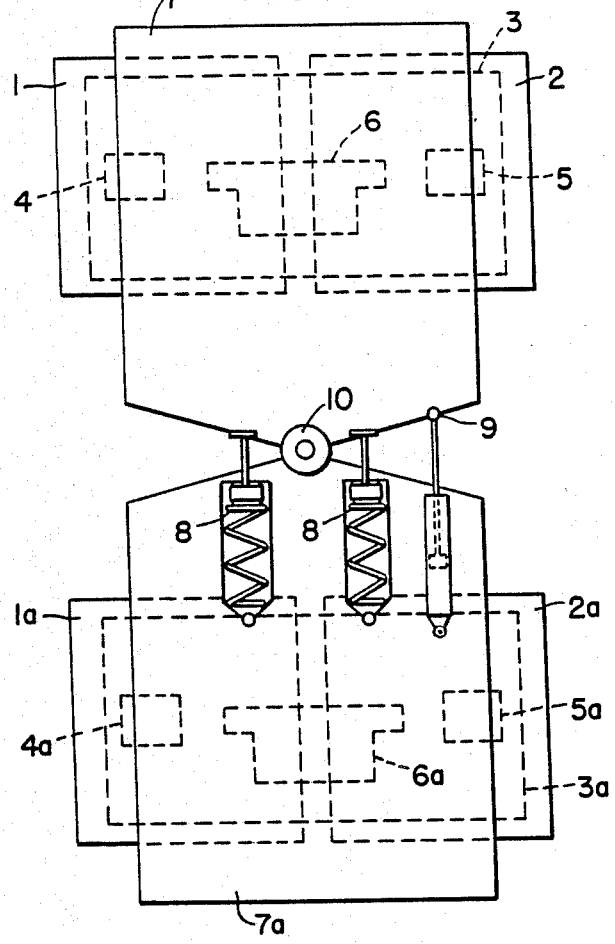
FIG. 1 is a schematic plan view of one inventive embodiment of a vibratory roller.

Referring now to the drawings in detail, the vibratory roller of FIG. 1 is provided with front drums 1 and 2, and rear drums 1*a* and 2*a*. The drums are rotatably mounted, independently of one another, and in pairs, in support means 3 and 3*a* that are common to the respective pairs. The drums are furthermore drive individually by an associated motor 4, 5, 4*a*, and 5*a*. A respective vibration exciter 6, 6*a* is accommodated in the two support means 3 and 3*a*. Each of the two support means 3 and 3*a*, in turn, is connected to a front roller frame 7 or a rear roller frame 7*a* in such a way that the support means are damped relative to the vibrations.

The front roller frame 7 and the rear roller frame 7*a* are interconnected via a hinged or swivel coupling 10 in such a way that they are pivotable relative to one another about an axis that extends at right angles to the ground. By means of two spring-loaded tension accumulators 8, the two roller frames 7, 7*a* are held in the relative straight ahead-angle position when the guide or steering cylinder 9, that is provided for the power-driven pivoting of the two roller frames 7, 7*a* for driving in curves, is not actuated.

Figure 2:
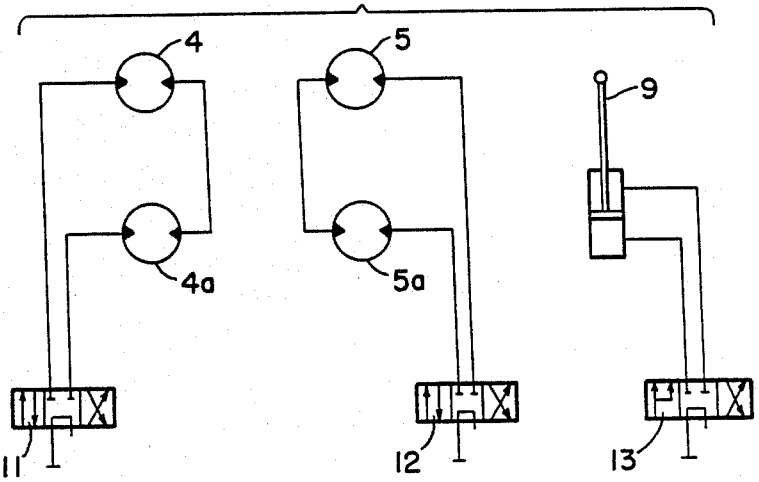
FIG. 2 is the hydraulic circuit diagram for the travel drive motors and the steering for the roller of FIG. 1, with the vibratory drive mechanism and the pumps not being shown.

In the hydraulic circuit diagram illustrated in FIG. 2, the reference numerals 11 and 12 each denote a 4/3-way valve for the left drive motors 4, 4*a* and the right drive motors 5, 5*a* respectively; the reference numeral 13 denotes a 4/3-way valve in the differential circuit for the hydraulic steering cylinder 9. The levers for the slide valves 11 and 12 can be actuated independently of one another, and are mechanically connected with the lever for the slide valve 13 in such a way that the valve 13 can be shifted into the position L only with the lever for the valve 11, and can be shifted into the position R only with the lever for the valve 12.

Figure 3:
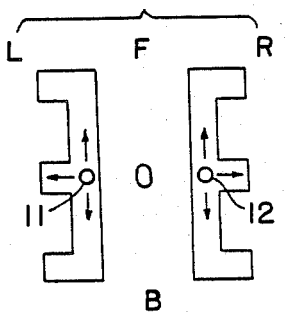
FIG. 3 shows the shift guide for the valve levers 11 and 12, along with the possible driving and steering maneuvers for the hydraulic circuit diagram of FIG. 2.

The shift guides shown in FIG. 3 for the levers of the valves 11 and 12 enable the following roller movements when the levers are in the corresponding listed positions:

| | Lever Position: Valve Lever | | |
|---|---|---|---|
| | 11 | 12 | Roller Movement: |
| 1. | F | F | Forward travel |
| 2. | B | B | Backward travel |
| 3. | F | B | Panzer steering, roller turns toward the right |
| 4. | B | F | Panzer steering, roller turns toward the left |
| 5. | LF | F | Forward travel with articulated steering toward the left |
| 6. | F | FR | Forward travel with articulated steering toward the right |
| 7. | LB | B | Backward travel with articulated steering toward the left |
| 8. | B | BR | Backward travel with articulated steering toward the right |
| 9. | LO | B | With left drums blocked, roller turns backward toward the left |
| 10. | LO | F | As in 9, but the roller turns forward toward the left |
| 11. | B | OR | With the right drums blocked, the roller turns backward toward the right |
| 12. | F | OR | Same as in 11, but the roller turns forward toward the right |
| 13. | F | BR | Roller turns toward the right, accelerated on the spot (Panzer and articulated steering) |
| 14. | LB | F | Same as in 13, but roller turns toward the left |
| | LF | B | No definite roller movement for |
| | B | FB | these lever positions. |

The present invention is, of course, in no way restricted to the specific disclosure of the specification and drawings, but also encompasses any modifications within the scope of the appended claims.

What I claim is:

1. A vibratory roller having sides and having four drums that can be vibrated; the drums are driven individually, and are rotatably mounted, in pairs, on a front or rear support means respectively, with the front support means being attached to a front frame, and the rear support means being attached to a rear frame; said vibratory roller further comprises in combination therewith:

a single hydraulic system to carry out two types of steering in one hydraulic system including a circuit, a hinged or swivel coupling that interconnects said front and rear frames by a pivot joint as well as to permit a diversified dual steering condition therewith including combination of both articulated steering capability via principle and structure of articulated steering and as well as panzer steering capability via principle and structure of panzer steering, said single hydraulic system being switchable between articulated steering capability as well as panzer steering capability during operation of the vibratory roller as said hydraulic system operates the roller drums in a selected direction without interrupting travel by two control levers;

said system including steering hydraulic cylinder means connected to said front and rear frames respectively for pivoting the latter relative to one another about said coupling in a bending control steering function for curve travel;

a multi-way valve means operatively connected in circuit with said steering hydraulic cylinder means;

tension accumulator means connected to said front and rear frames primarily for an alignment function thereof relative to each other; other than when said steering hydraulic cylinder means is actuated, said front and rear frames are held by said accumulator means in a relative angular position in which upon switching from articulated steering capability to panzer steering when said steering hydraulic cylinder means employed for articulated steering capability has been turned-off so that said pairs of drums are centered without any force and holding effect by said hydraulic cylinder means concurrently with said multi-way valve means being aligned positively as to each other to assume a straight-ahead travel position determined by said tension accumulator means that only align the drums for the alignment function attributable thereto; and drive means for said drums; each pair of drums having a drum on each side of said roller when viewed in the direction of straight-ahead travel, with the drive means of those drums of both pairs of drums disposed on a given side of said roller being controllable in common and independently of those drums disposed on the other side of said roller for steering movement in the bending control steering function only via desired and wanted actuation of said multi-way valve means during operation of the vibratory roller with which normal travel with limited changes in direction as well as slight corrections of direction is carried out pursuant to the principle of articulated steering that enables immediate changes in direction without interrupting travel and without damaging already compacted ground on one hand and on the other hand permits a rotation on the spot pursuant to the principle of panzer steering with the aid of the tension accumulator means, which for this purpose, other than when the steering cylinder means is actuated, effectively makes the two pivotally interconnected front and rear frames an essentially rigid unit that is essentially aligned for straight-ahead travel.

2. A vibratory roller in combination according to claim 1, in which each of said support means is provided with a respective vibration exciter accommodated therein.

3. A vibratory roller in combination according to claim 2, in which said tension accumulator means is springloaded.

* * * * *